US007091429B2

(12) United States Patent
Case et al.

(10) Patent No.: US 7,091,429 B2
(45) Date of Patent: Aug. 15, 2006

(54) PRIVACY KEYPAD

(75) Inventors: Christopher N. Case, Knoxville, TN (US); Robert C. Hunt, Reno, NV (US)

(73) Assignee: Yale Security Inc., Monroe, NC (US)

( * ) Notice: Subject to any disclaimer, the term of this patent is extended or adjusted under 35 U.S.C. 154(b) by 139 days.

(21) Appl. No.: 10/707,566

(22) Filed: Dec. 22, 2003

(65) Prior Publication Data

US 2005/0134484 A1 Jun. 23, 2005

(51) Int. Cl.
*H01H 9/00* (2006.01)
*H01H 9/30* (2006.01)

(52) U.S. Cl. ..... 200/5 A; 200/314; 70/282; 70/211; 70/278; 362/84; 362/26

(58) Field of Classification Search ..... 200/1 R, 200/5 A, 314, 321; 362/84–85, 26; 70/282–285, 70/207–211, 278–279
See application file for complete search history.

(56) References Cited

U.S. PATENT DOCUMENTS

| | | | |
|---|---|---|---|
| 3,041,720 | A | 7/1962 | Pantas |
| D279,647 | S | 7/1985 | Ohno |
| D280,073 | S | 8/1985 | Wildgen |
| D280,799 | S | 10/1985 | Ohno |
| 4,632,511 | A | 12/1986 | Louw |
| D297,911 | S | 10/1988 | Rubin |
| 4,899,562 | A | 2/1990 | Gartner et al. |
| 4,901,545 | A | 2/1990 | Bacon et al. |
| D313,159 | S | 12/1990 | Kautt |
| D313,926 | S | 1/1991 | Kautt |
| 5,060,991 | A | 10/1991 | Davidian et al. |
| 5,136,870 | A | 8/1992 | Gartner et al. |
| 5,301,230 | A | 4/1994 | Barry |
| 5,353,349 | A | 10/1994 | Brown |
| 5,465,090 | A | 11/1995 | Deignan |
| 5,475,996 | A | 12/1995 | Chen |
| D365,976 | S | 1/1996 | Chiu |
| 5,564,486 | A | 10/1996 | Deigman |

(Continued)

FOREIGN PATENT DOCUMENTS

| | | |
|---|---|---|
| WO | WO 00/11622 | 3/2000 |

(Continued)

OTHER PUBLICATIONS

SIMPLEX® Ad, *The National Locksmith*, Jan. 2004 issue, vol. 75, No. 1, p. 75.

(Continued)

*Primary Examiner*—K. Lee
(74) *Attorney, Agent, or Firm*—Moore & Van Allen PLLC; Matthew W. Witsil; Michael G. Johnston

(57) ABSTRACT

A privacy keypad providing privacy for keypad character entry and concealment of a joint in an escutcheon. A privacy keypad may include a faceplate, a keypad disposed on the faceplate, and at least one protrusion integral with the faceplate. An escutcheon for a door lock may include a housing, a keypad disposed on the housing for unlocking the door lock, and at least one protrusion integral with the housing. The protrusion may obstruct at least partially a line of sight to the keypad. An escutcheon may include top and bottom covers with the top cover projecting outward from the surface of a door more than the lower cover, resulting in an at least partially hidden joint between covers. Top and bottom covers may be interchangeable with covers having similar edges.

20 Claims, 6 Drawing Sheets

U.S. PATENT DOCUMENTS 5,609,051 A 3/1997 Donaldson
5,640,863 A 6/1997 Frolov
5,651,450 A * 7/1997 Priesemuth ..... 200/314
5,657,386 A 8/1997 Schwanke
5,709,114 A 1/1998 Dawson et al.
5,748,728 A 5/1998 Ginsberg et al.
5,775,142 A 7/1998 Kim
5,873,276 A 2/1999 Dawson et al.
6,286,347 B1 9/2001 Frolov
6,318,134 B1 * 11/2001 Mossberg et al. ..... 70/63
D452,230 S 12/2001 Taylor et al.
D452,231 S 12/2001 Taylor et al.
6,378,344 B1 4/2002 Gartner
D470,033 S 2/2003 Fleury et al.
6,516,641 B1 2/2003 Segawa
D472,794 S 4/2003 LaPlume et al.
6,543,684 B1 4/2003 White et al.
D474,103 S 5/2003 Kaiser et al.

FOREIGN PATENT DOCUMENTS

WO WO 00/66859 11/2000

OTHER PUBLICATIONS

Stand Alone Access Control, *The National Locksmith*, Oct. 2003 issue, vol. 74, No. 10, pp. 18, 22, 23, 24, 26, and 28.

* cited by examiner

PRIVACY KEYPAD

BACKGROUND OF INVENTION

The invention relates to the field of privacy keypads, and more particularly concerns concealment of operation of a keypad in an escutcheon for a door lock and concealment of a joint in an escutcheon.

Keypads are often used to enter private or secure information. For example, such information includes codes for operating door locks, banking account numbers and passwords, and long distance calling card numbers. In order to prevent people positioned behind or adjacent to a user from viewing the keypad, the user must position his or her body or hand over the keypad. In some instances doing so may be difficult or socially awkward, and in general a user may neglect to take such a precaution.

A keypad is disposed on an escutcheon for an electronic door lock for operation of the lock. Upon entry of a predetermined code, the keypad sends an electrical signal to the lock that unlocks the lock. Shields may be used to obstruct the view of the keypad. A conventional shield for a keypad may obstruct the view of the keypad with a front element that covers the keypad and side elements adjacent to the keypad. The front element may be stationary, leaving enough room for a user's hand to operate the keys, or may move, for example, by having a hinge that allows that element to rotate away from the keypad enough to allow a user's hand to operate the keys. The front element may be opaque, which impedes the view by the user, or it may be polarized, preventing view through the element at an angle but allowing direct viewing. However, the front element can interfere with free operation of the keypad. Further, the front element is a part commonly separate from the device that includes the keypad, and is subject to breakage and vandalism.

Side elements are generally mounted vertically adjacent to the sides of the keypad and may also be opaque or polarized. Unfortunately, like the front element, the side elements are parts that are commonly separate from the device that includes the keypad, and accordingly are also subject to damage.

Accordingly, there exists a need for a view-shielding means that is integral with a door escutcheon that includes a keypad and reduces opportunity for damage.

SUMMARY OF INVENTION

In accordance with an embodiment of the present invention, a privacy keypad includes a faceplate, a keypad, and at least one protrusion. The keypad is disposed on the faceplate. The protrusion is integral with the faceplate and extends upwardly from the surface of the faceplate laterally adjacent to the keypad. The protrusion obstructs at least partially a line of sight to the keypad by being of a sufficient height and length along the central longitudinal axis of the keypad to do so. The protrusion may be of unitary construction with the faceplate. A line from the center point of the keypad normal to the central longitudinal axis of the keypad to the top of a protrusion may form an angle of at least about 10 degrees with a plane tangential to the surface of the faceplate along the central longitudinal axis of the keypad.

In another embodiment according to the present invention, a privacy keypad includes two parallel protrusions laterally adjacent to and on opposite sides of the keypad. Each protrusion at least partially obstructs a line of sight to the keypad. The protrusions may define a longitudinal channel in the faceplate for receiving the keypad.

In another embodiment according to the present invention, a privacy keypad includes a faceplate, a keypad disposed on the faceplate, and two parallel protrusions. The two parallel protrusions extend upwardly from the surface of the faceplate laterally adjacent to and on opposite sides of the keypad to define a longitudinal channel in the faceplate for receiving the keypad. The protrusions are integral and of unitary construction with the faceplate, and each protrusion is of a sufficient height and length along the longitudinal axis of the keypad to obstruct at least partially a line of sight to the keypad.

In another embodiment according to present invention, an escutcheon for a door lock includes a housing, a keypad, and at least one protrusion. The keypad is disposed on the housing for unlocking the door lock. The protrusion is integral with the housing and extends upwardly from the surface of the housing laterally adjacent to the keypad. The protrusion obstructs at least partially a line of sight to the keypad by being of a sufficient height and length along the central longitudinal axis of the keypad to do so. The protrusion may be of unitary construction with the housing. A line from the center point of the keypad normal to the central longitudinal axis of the keypad to the top of a protrusion may form an angle of at least about 10 degrees with a plane tangential to the surface of the housing along the central longitudinal axis of the keypad.

In another embodiment according to the present invention, an escutcheon for a door lock includes two parallel protrusions laterally adjacent to and on opposite sides of the keypad. Each protrusion at least partially obstructs a line of sight to the keypad. The protrusions may define a longitudinal channel in the housing for receiving the keypad.

In another embodiment according to the present invention, an escutcheon for a door lock includes a housing and a keypad disposed on the housing for unlocking the door lock. Two parallel protrusions extend upwardly from the surface of the housing laterally adjacent to and on opposite sides of the keypad to define a longitudinal channel in the housing for receiving the keypad. The protrusions are integral and of unitary construction with the housing, and each protrusion is of a sufficient height and length along the longitudinal axis of the keypad to obstruct at least partially a line of sight to the keypad.

In another embodiment according to the present invention, a lockset for a door includes a housing, a lock, and a keypad operatively connected to the lock for unlocking the lock by electrical signal. The lock is disposed in and the keypad is disposed on the housing. Two parallel protrusions extend upwardly from the surface of the housing laterally adjacent to and on opposite sides of the keypad to define a longitudinal channel in the housing for receiving the keypad. The protrusions are integral with the housing, and each protrusion is of a sufficient height and length along the longitudinal axis of the keypad to obstruct at least partially a line of sight to the keypad. The protrusions may be of unitary construction with the housing.

In another embodiment according to the present invention, an escutcheon for a door lock includes a lower cover having an opening through which a door latch operator passes. The lower cover has a surface projecting a first distance away from the surface of the door and has a top edge. An upper cover having a bottom edge has a surface that projects away from the surface of the door a second distance that is greater than the first distance. The upper cover is mounted to the surface of the door above the lower cover such that the bottom edge of the upper cover and top edge of the lower cover are in close and complementary registration. The top edge of the lower cover and the bottom edge of the upper cover may be arcuate. The arcuate top edge of the lower cover may be convex while the arcuate bottom edge of the upper cover is concave. The arcuate top edge of the lower cover may be concave while the arcuate bottom edge of the upper cover is convex.

In another embodiment according to the present invention, an escutcheon system for a lock on a door includes a lower cover through which a latch operator passes, adapted to be mounted to the surface of the door and having a top edge. A first upper cover has a bottom edge. The first upper cover is adapted to be mounted to the surface of the door above the lower cover such that the bottom edge of the first upper cover and the top edge of the lower cover are in close and complementary registration. A second upper cover differing from the first upper cover in size, features, or a combination thereof, has a bottom edge. Like the first upper cover, the second upper cover is adapted to be mounted to the surface of the door above the lower cover such that the bottom edge of the second upper cover and top edge of the lower cover are in close and complementary registration. The top edge of the lower cover, bottom edge of the first top cover, and bottom edge of the second lower cover may be arcuate.

In another embodiment according to the present invention, an escutcheon system for a lock on a door includes an upper cover adapted to be mounted to the surface of the door and having a bottom edge. A first lower cover through which a latch operator passes has a top edge. The first lower cover is adapted to be mounted to the surface of the door below the upper cover such that the top edge of the first lower cover and bottom edge of the upper cover are in close and complementary registration. A second lower cover through which a latch operator passes differs from the first upper cover in size, features, or a combination thereof. The second lower cover has a top edge. Like the first lower cover, the second lower cover is adapted to be mounted to the surface of the door below the upper cover such that the top edge of the second lower cover and bottom edge of the upper cover are in close and complementary registration. The bottom edge of the upper cover, top edge of the first lower cover, and top edge of the second lower cover may arcuate.

DETAILED DESCRIPTION

Figure 1:
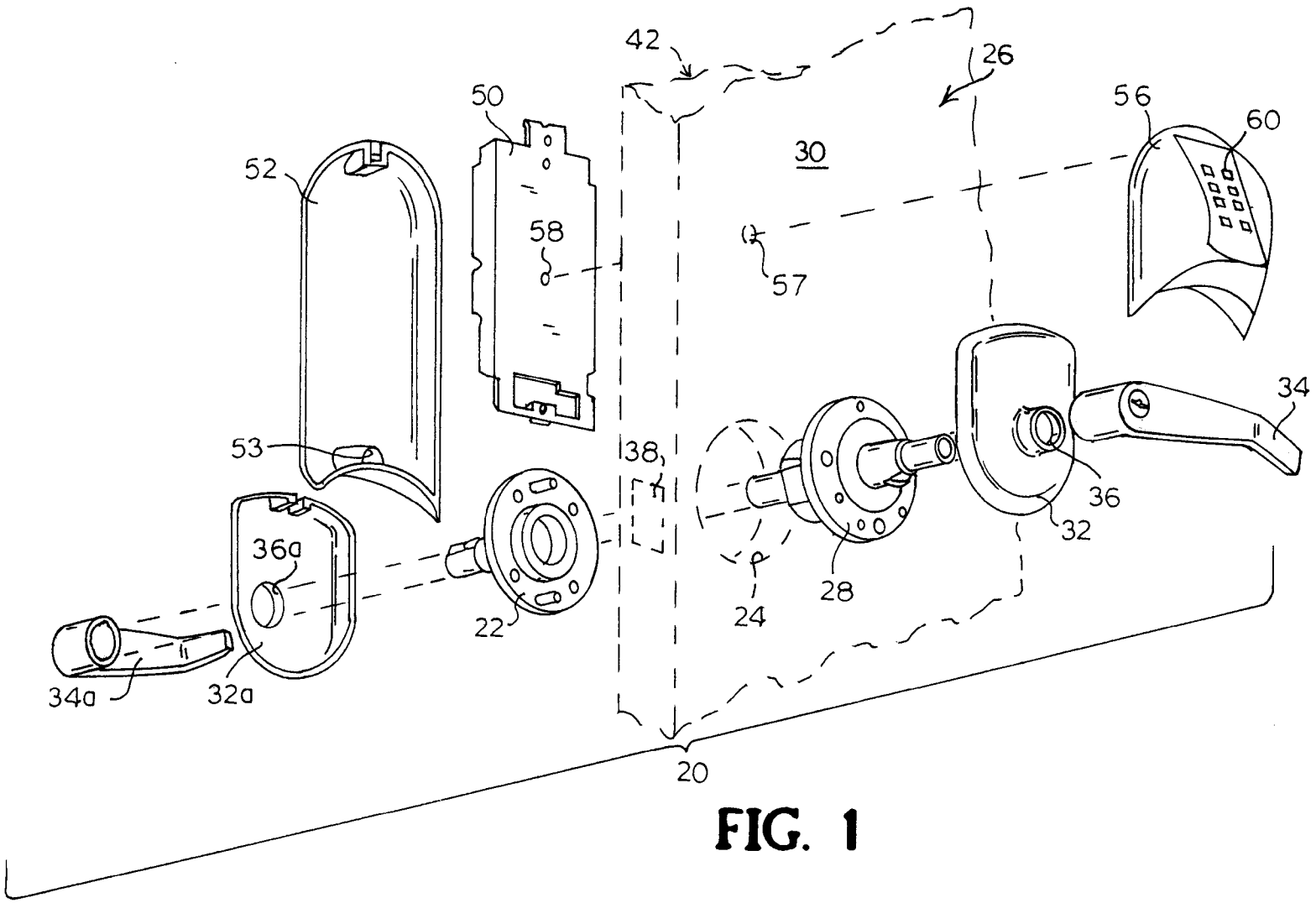
FIG. 1 is an exploded perspective view of an embodiment of a lockset according to the present invention.

In the Figures herein, unique features receive unique reference numerals, while features that are the same in more than one drawing receive the same reference numerals throughout. Where a feature is modified between figures or is modified only by a change in location, a letter may be added or changed after the feature reference numeral to distinguish that feature from a similar feature in a previous figure or the same feature in an alternate location. Further, certain terms of orientation may be used, such as "upper", "lower", "top", "bottom", "left", "right", "inside", "outside", "inner", and "outer". These terms are generally for convenience of reference, and should be so understood unless a particular embodiment requires otherwise.

The scope of the invention is not intended to be limited by materials listed herein, but may be carried out using any materials that allow the construction and operation of the present invention. Materials and dimensions depend on the particular application. In general the materials of the components may be metal, and selectively may be plastic, as known by one of ordinary skill in the art.

Referring now to the drawings, an embodiment of a lockset 20 according to the present invention is shown in FIG. 1. The lockset 20 includes an inner rose assembly 22 mounted through an opening 24 in a door 26 to an outer rose assembly 28 as is conventional. Fasteners and electrical wiring are omitted from FIG. 1 for clarity.

Figure 4:
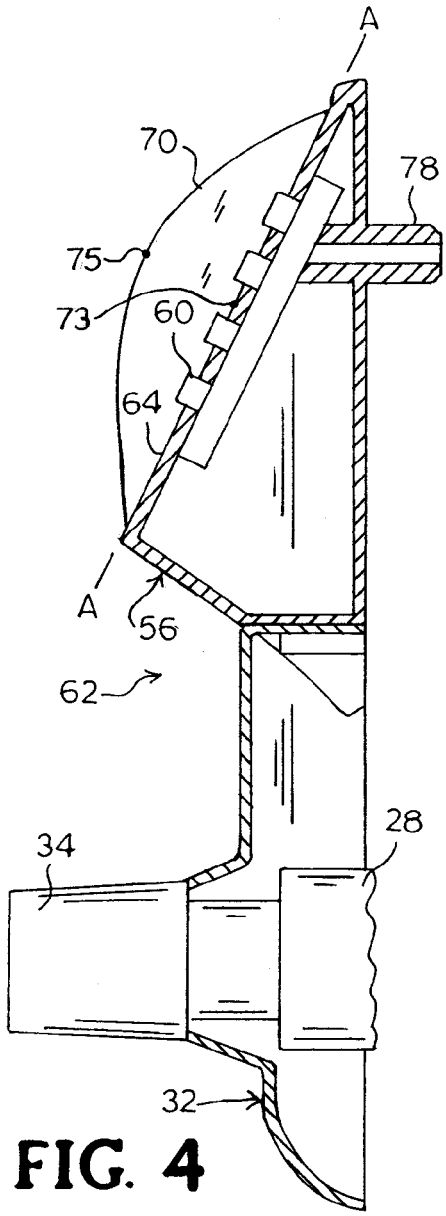
FIG. 4 is a section view of the escutcheon and door handle taken along the line 4—4 of FIG. 2.

A lower cover 32 fits over the outer rose assembly 28 and against the outside surface 30 of the door 26. An opening 36 in the lower cover 32 allows connection of an outside lever handle 34 to an operating spindle associated with the outer rose assembly 28. As best seen in FIG. 4, the diameter of the hub of the outside lever handle 34 is slightly larger than the opening 36 in the lower cover 32 so that the lower cover 32 is held snugly against the outside surface 30 of the door 26. Referring again to FIG. 1, a lower cover 32*a* is similarly mounted against the inside surface 42 of the door 26. Specifically, a hub of an inside lever handle 34*a* having a diameter slightly larger than an opening 36*a* in the lower cover 32*a* is fixed for rotation with an operating spindle associated with the inner rose assembly 22. It is understood that rotation of either handle 34, 34*a* functions to retract a latch (not shown) which extends through an opening 38 in the edge of the door 26.

A battery holder 50 is fastened to the inside surface 42 of the door 26 above the lower cover 32*a* for accommodating batteries (not shown) which provide an electrical power source for operating the lockset 20. An upper cover 52 is fastened to the battery holder 50 and against the inside surface 42 of the door 26 with a fastener (not shown) through an opening 53 in the upper cover 52. Similarly, an upper cover 56 is mounted against the outside surface 30 of the door 26 above the lower cover 32. The upper cover 56 includes a transverse threaded socket 78 (FIGS. 3 and 4) that is received in an opening 57 in the door 26. A fastener (not shown) extends through an opening 58 in the battery holder 50 for securing the outer upper cover 56 to the door 26. The upper and lower covers 52, 32*a*, 56, 32 on each side of the door 26 form inner and outer escutcheon housings, respectively. A keypad 60 is provided on the outer upper cover 56.

Figure 2:
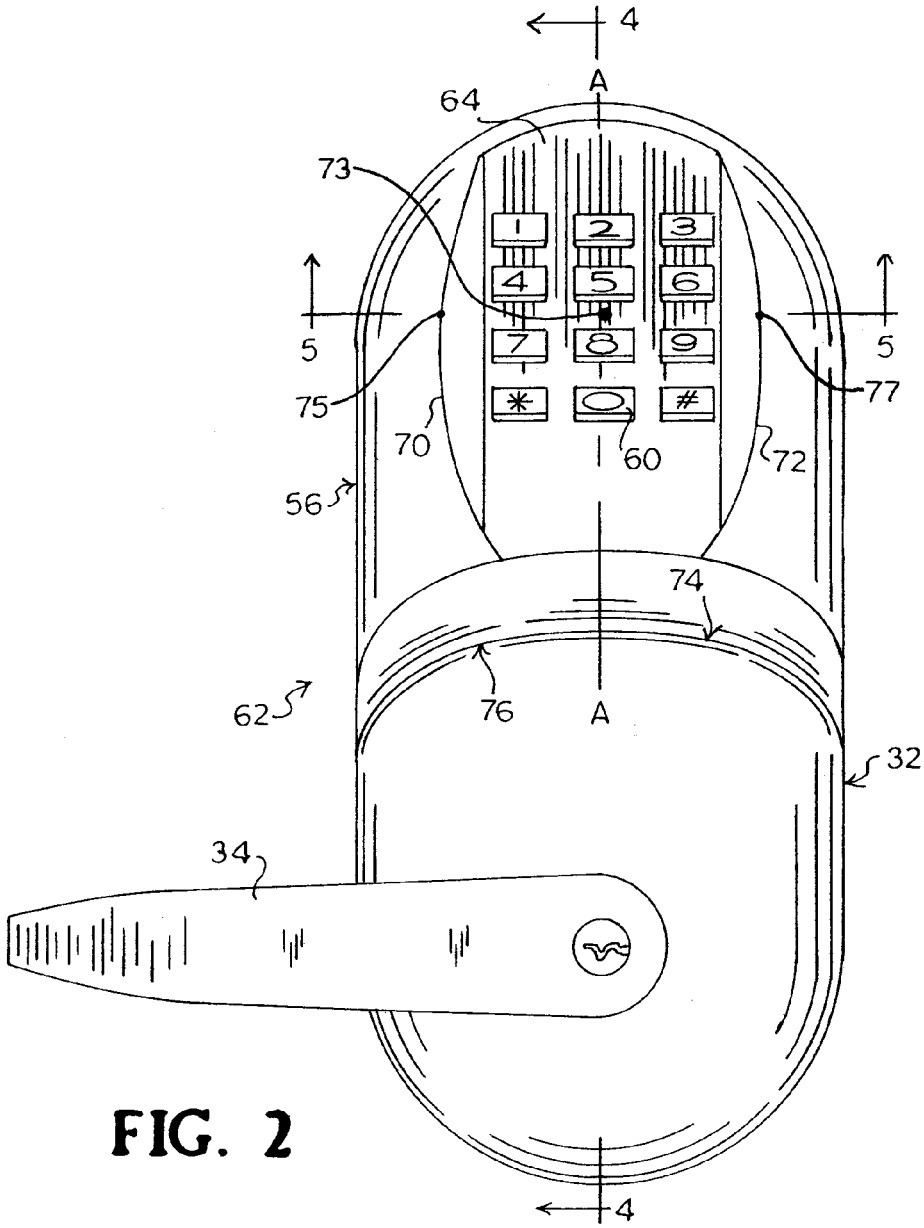
FIG. 2 is a front elevation view of an outer escutcheon and door handle of the lockset of FIG. 1.

The outer escutcheon 62 is shown in FIG. 2. The bottom edge 74 of the upper cover 56 is concave and mates with the top edge 76 of the lower cover 32, which is convex. A channel 64 having a central longitudinal axis A—A is formed in the surface of the upper cover 56 and is defined by upstanding sidewalls 70, 72. In this embodiment of the present invention, the sidewalls 70, 72 are of unitary construction with the upper cover 56, in that the sidewalls 70, 72 and upper cover 56 are all formed from one piece of material. This integral and unitary construction reduces or eliminates the opportunity for damage to the sidewalls 70, 72.

The keypad 60 is mounted in the channel 64. In this embodiment the central longitudinal axis A—A of the channel 64 is also the central longitudinal axis of the keypad 60. The keypad 60 may comprise a touch sensitive device or buttons, as shown, that extend outwardly from the surface of the channel 64. The channel 64 that is shown has a substantially planar surface, but other shapes such as a curved surface or the like may be used.

Figure 5:
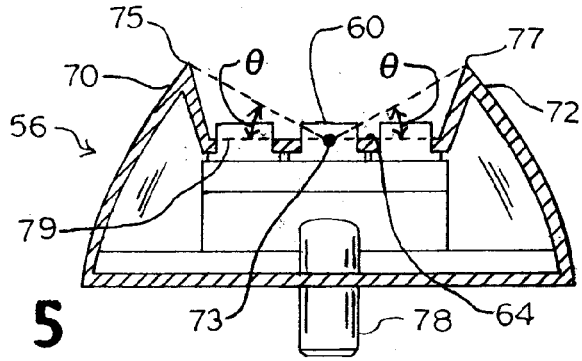
FIG. 5 is a section view of the escutcheon and door handle taken along the line 5—5 of FIG. 2.
Figure 3:
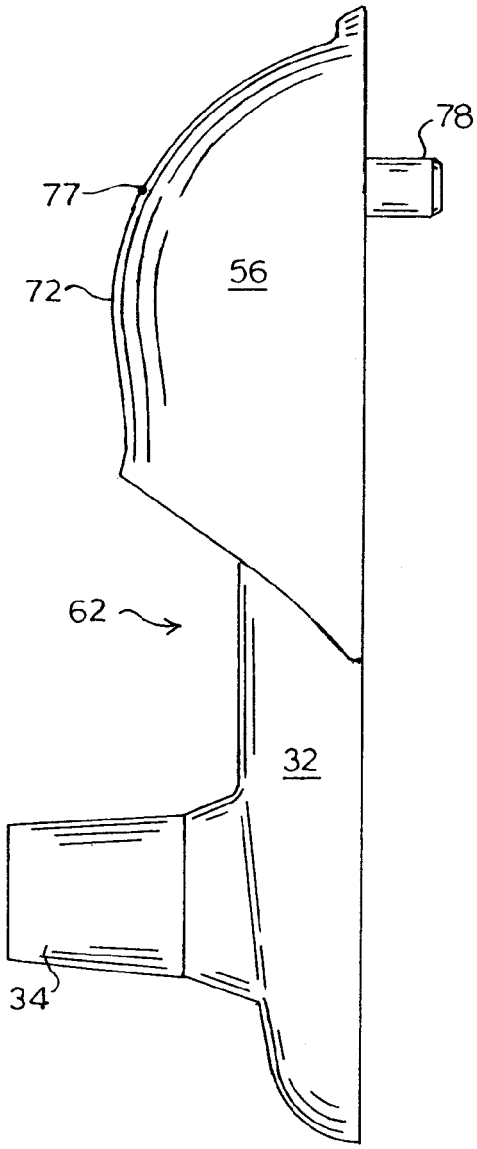
FIG. 3 is a side elevation view of the outer escutcheon and door handle of FIG. 2.

As best seen in FIG. 3, when the outer escutcheon 62 is viewed from a position adjacent to the door 26, the keypad 60 is obstructed by the sidewalls 70, 72 that shield the keypad 60. FIGS. 4 and 5 are section views of the outer escutcheon 62 showing that the sidewalls 70, 72 protrude from the surface of the channel 64 and beyond the keys to shield the keypad 60 from the view of an observer.

To shield the keypad from the view of an observer the sidewalls 70, 72 must be a certain height. The height of a sidewall 70, 72 may be determined by considering that the sidewalls 70, 72 protrude to a height from the surface of the channel 64 that corresponds to a predetermined angle from the center of the keypad 60, in conjunction with the lateral spacing of the sidewalls 70, 72 from the keypad 60. Referring to FIGS. 2, 4, and 5, this necessary height is best shown by a line from the center point 73 of the keypad 60 normal to the central longitudinal axis A—A to the top 75, 77 of the sidewall 70, 72 that forms an angle □ of at least about 10 degrees with a plane 79 tangential to the surface of the channel 64 along the central longitudinal axis A—A. In the embodiment shown, the tops 75, 77 of the sidewalls 70, 72 are closely adjacent to the keypad 60 and are sufficiently close to obstruct at least partially the view of the keypad 60 by an observer. The sidewalls 70, 72 may taper longitudinally as shown, but need not do so and must remain a height that continues to obstruct at least partially the view of the keypad 60 by an observer.

Figure 6:
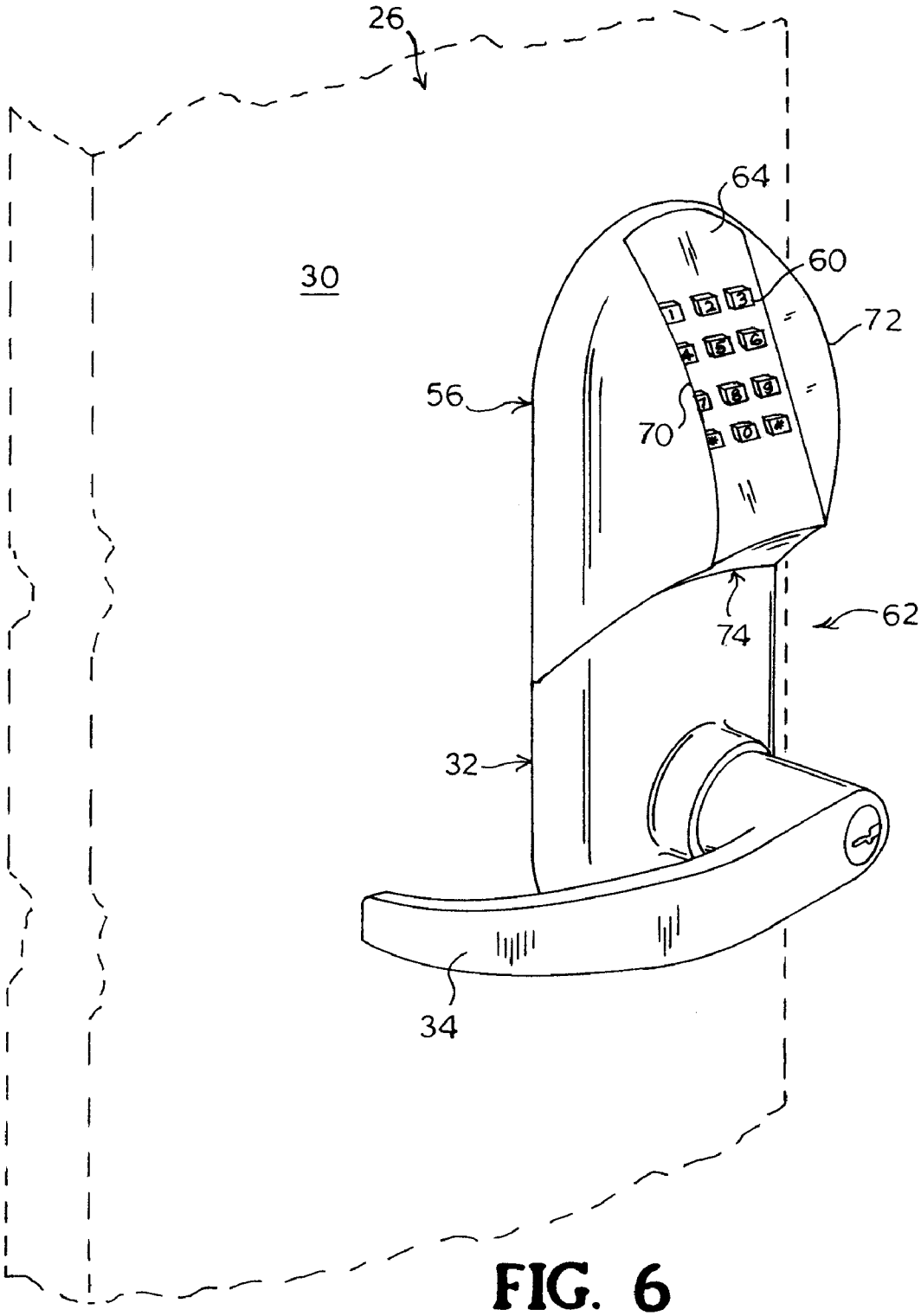
FIG. 6 is a perspective view of the escutcheon and door handle of FIG. 2.

FIG. 6 is a perspective view of the outer escutcheon 62 as viewed by a typical observer. This figure shows that as the outer escutcheon 62 is viewed from this angle, the line of sight to the keypad 60 is obstructed. The keypad 60 becomes less visible as the observer moves closer to the door 26. Also, from the vantage point shown in FIG. 6, the line of sight to the joint between the upper cover 56 and lower cover 32 is obstructed. Even where the joint may be in view, the joint can appear to be a bend in the escutcheon 62 rather than a joint between two parts.

Figure 7:
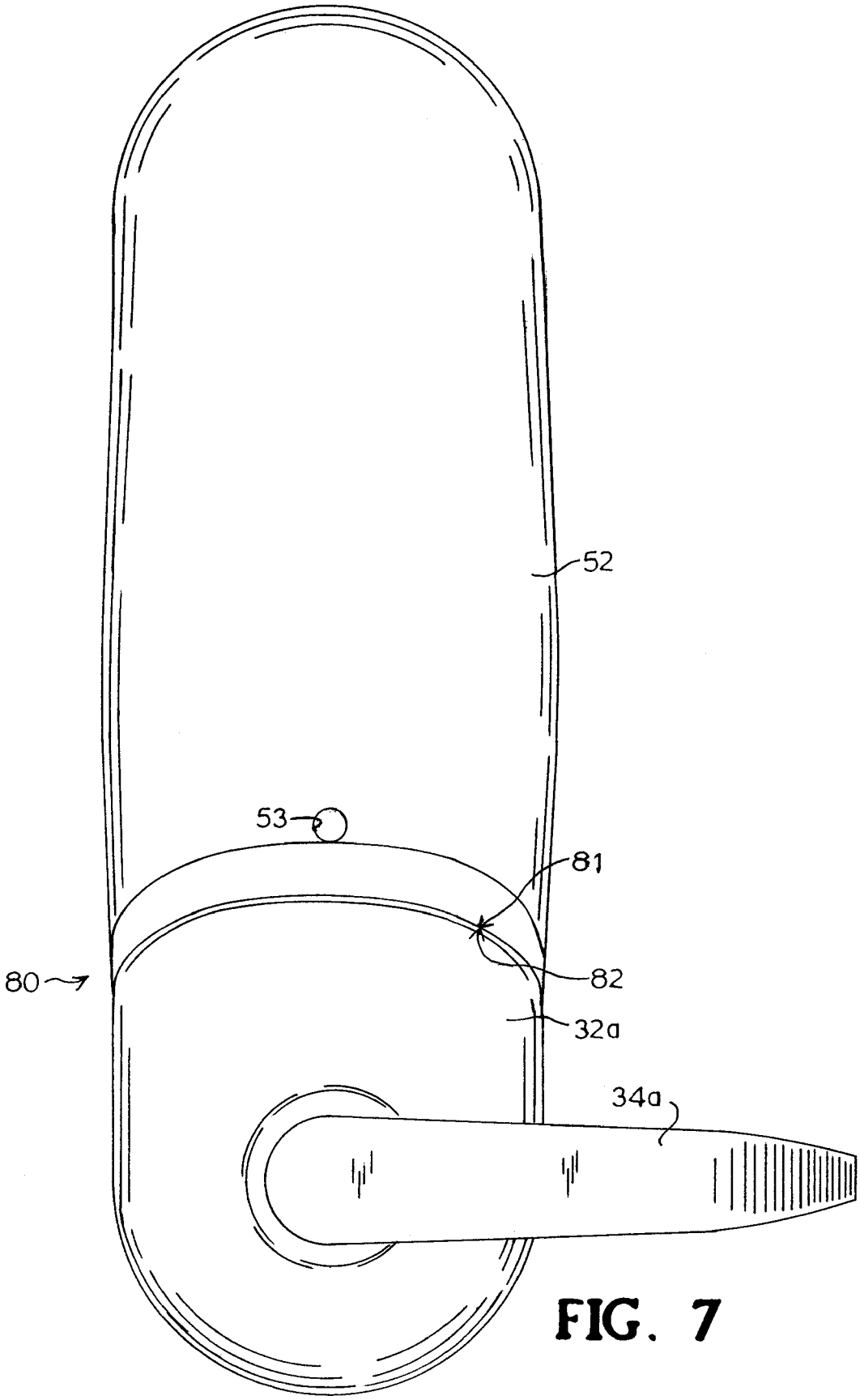
FIG. 7 is a front elevation view of an inner escutcheon and door handle of the lockset of FIG. 1.

The inside escutcheon 80, comprising an upper cover 52 that covers the battery holder 50 and the lower cover 32*a*, is shown in FIG. 7. The bottom edge 81 of the upper cover 52 is concave and mates with the upper edge 82 of the lower cover 32*a*, which is convex. Conversely, the bottom edge of the upper cover 52 could be convex and the top edge of the lower cover 32*a* could be concave. In addition, the bottom edges of the upper covers 52, 56 and the top edges of the lower covers 32, 32*a* could be straight. A feature of the present invention is the ability to interchange upper covers and lower covers of different shape as long as they have complimentary edges that mate to form a continuous joint. For example, the outer upper cover 56 and inner upper cover 52 are interchangeable because they fit with complementary lower covers.

Figure 8:
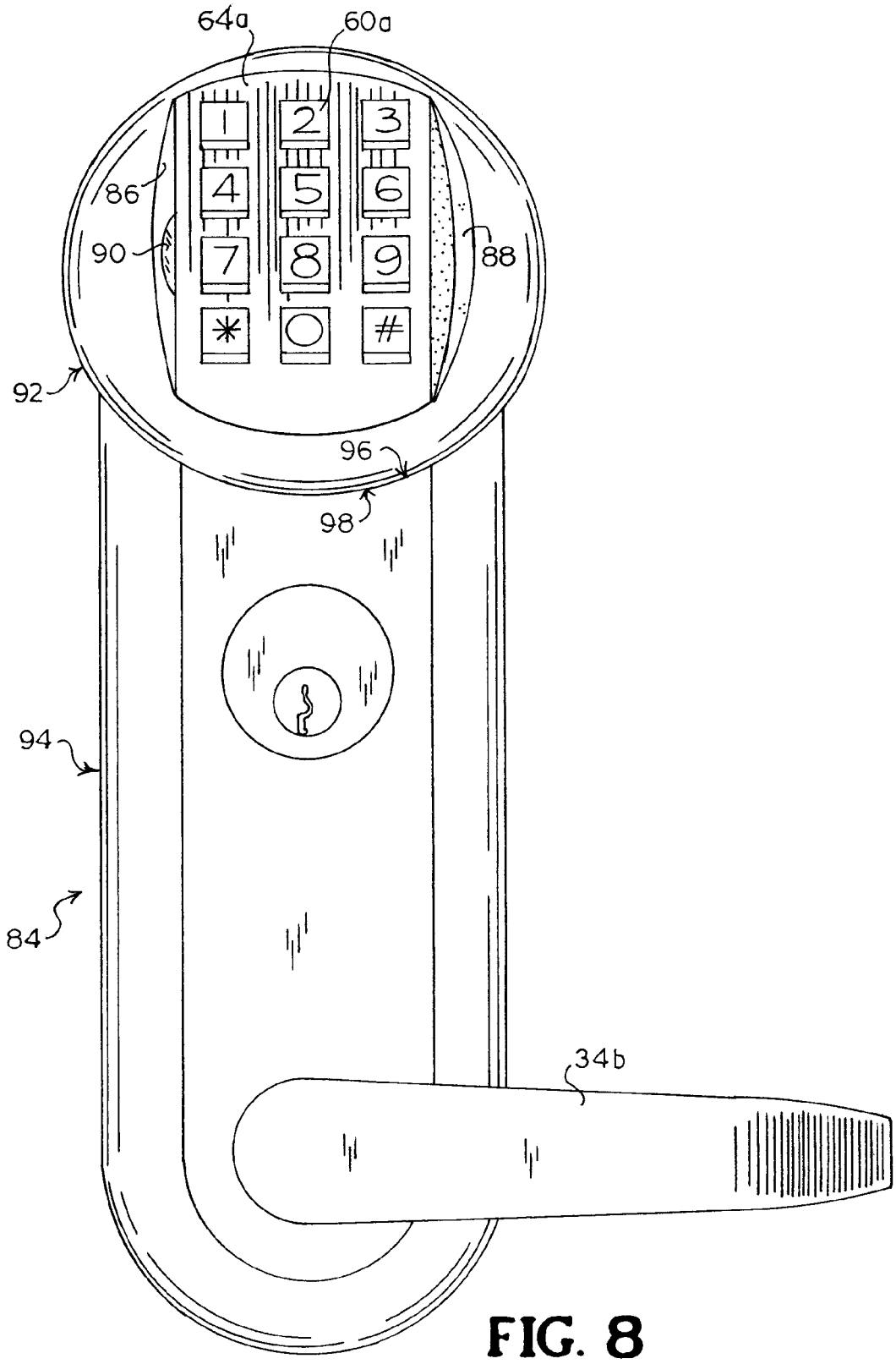
FIG. 8 is a front elevation view of another embodiment of an outer escutcheon and door handle according to the present invention.

Another embodiment of an outer escutcheon is shown in FIG. 8 and generally designated at 84. This embodiment includes an upper cover 92 and a lower cover 94. The upper cover 92 is generally circular in cross-section. The lower cover 94 is elongated relative to that of the prior embodiment of the outer lower cover 32. The bottom edge 96 of the upper cover 92 is convex, and mates with the top edge 98 of the lower cover 94, which is concave. Similarly to the previous embodiments, the upper cover 92 and lower cover 94 may be interchanged with other parts having like joint edges.

Similar to the previously described embodiment of the outer escutcheon 62, a keypad 60*a* is disposed in a longitudinal channel 64*a* defined by upstanding sidewalls 86, 88 on the upper cover 92. The sidewalls 86, 88 are similar to those in the previous embodiment 62 in that the sidewalls 86, 88 are integral with and are a part of the upper cover 92, but differ in that they are not of unitary construction. One sidewall 88 is made of rubber and may be bonded or otherwise attached to the remainder of the upper cover 92. A light source 90, such as a light emitting diode, is provided in one of the sidewalls 86 for illuminating the keypad 60*a*. Optionally light sources may be located on both sidewalls 86, 88.

Specific embodiments of an invention are described herein. One of ordinary skill in the lock and security hardware arts will recognize that the invention has other applications in other environments. In fact, many embodiments and implementations are possible. For example, the escutcheon of the present invention may be made in different shapes and sizes. The mating edges of upper and lower covers may be straight or arcuate, so long as they are in close and complimentary registration. The sidewalls could be applied as shields anywhere keypad security is needed. In addition, the recitation "means for" is intended to evoke a means-plus-function reading of an element in a claim, whereas, any elements that do not specifically use the recitation "means for", are not intended to be read as means-plus-function elements, even if they otherwise include the word "means". The following claims are in no way intended to limit the scope of the invention to the specific embodiments described.

What is claimed is:

1. A privacy keypad comprising:

a faceplate;

a keypad disposed on the faceplate and having a central longitudinal axis and a center point; and at least one protrusion integral with the faceplate and extending upwardly from the surface of the faceplate laterally adjacent to the keypad, wherein the at least one protrusion is of a sufficient height and length along the central longitudinal axis of the keypad to obstruct at least partially a line of sight to the keypad, and wherein a line from the center point of the keypad normal to the central longitudinal axis of the keypad to the top of the at least one protrusion forms an angle of at least 20 degrees with a plane tangential to the surface of the faceplate along the central longitudinal axis of the keypad.

2. The privacy keypad as recited in claim 1, further comprising a housing and wherein the at least one protrusion is of unitary construction with the housing.

3. The privacy keypad as recited in claim 1, wherein the faceplate comprises a substantially planar portion on which the keypad is disposed.

4. The privacy keypad as recited in claim 1, wherein the at least one protrusion comprises a light source.

5. The privacy keypad as recited in claim 4, wherein the light source is a light emitting diode.

6. The privacy keypad as recited in claim 1, wherein the at least one protrusion consists of two protrusions laterally adjacent to the central longitudinal axis of the keypad and on opposite sides of the keypad, and wherein each protrusion at least partially obstructs a line of sight to the keypad.

7. The privacy keypad as recited in claim 6, wherein the protrusions define with the faceplate a longitudinal channel for receiving the keypad.

8. The privacy keypad of claim 6, wherein the two protrusions are parallel to each other.

9. The privacy keypad of claim 1, wherein the at least one protrusion is parallel to the central longitudinal axis of the keypad.

10. An A privacy keypad, comprising:

a faceplate;

a keypad disposed on the faceplate and having a central longitudinal axis; and two protrusions, extending upwardly from the surface of the faceplate laterally adjacent to and on opposite sides of the keypad to define a longitudinal channel in the faceplate for receiving the keypad, wherein the protrusions are integral and of unitary construction with the faceplate, and each protrusion is of a sufficient height and length along the central longitudinal axis of the keypad to obstruct at least partially a line of sight to the keypad, and wherein a line from the center point of the keypad normal to the central longitudinal axis of the keypad to the top of at least one protrusion forms an angle of at least 20 degrees with a plane tangential to the surface of the faceplate along the central longitudinal axis of the keypad.

11. The privacy keypad of claim 10, wherein the two protrusions are parallel to each other.

12. A privacy keypad comprising:

a faceplate;

a keypad disposed on the faceplate and having a central longitudinal axis; and exactly two protrusions extending upwardly from the surface of the faceplate laterally adjacent to and on opposite sides of the keypad, wherein the two protrusions are of sufficient height and length along the central longitudinal axis of the keypad to obstruct at least partially a line of sight to the keypad.

13. The privacy keypad as recited in claim 12, further comprising a housing and wherein the two protrusions are of unitary construction with the housing.

14. The privacy keypad as recited in claim 12, wherein a line from the center point of the keypad normal to the central longitudinal axis of the keypad to the top of at least one protrusion forms an angle of at least 20 degrees with a plane tangential to the surface of the faceplate along the central longitudinal axis of the keypad.

15. The privacy keypad as recited in claim 12, wherein at least one protrusion comprises a light source.

16. The privacy keypad as recited in claim 15, wherein the light source is a light emitting diode.

17. The privacy keypad as recited in claim 12, wherein the protrusions define with the faceplate a longitudinal channel having open ends.

18. A privacy keypad comprising:

a faceplate;

a keypad disposed on the faceplate and having a central longitudinal axis; and a plurality of protrusions extending upwardly from the surface of the faceplate laterally adjacent to and on opposite sides of the keypad, wherein the plurality of protrusions defines a channel having open ends, and wherein the plurality of protrusions is of sufficient height and length along the central longitudinal axis of the keypad to obstruct at least partially a line of sight to the keypad.

19. A privacy keypad comprising:

a faceplate;

a keypad disposed on the faceplate and having a central longitudinal axis; and at least one protrusion integral with the faceplate and extending upwardly from the surface of the faceplate laterally adjacent to the keypad, wherein the at least one protrusion is of a sufficient height and length along the central longitudinal axis of the keypad to obstruct at least partially a line of sight to the keypad, and wherein the at least one protrusion comprises a light source.

20. The privacy keypad as recited in claim 19, wherein the light source is a light emitting diode.

* * * * *

UNITED STATES PATENT AND TRADEMARK OFFICE

CERTIFICATE OF CORRECTION

PATENT NO. : 7,091,429 B2
APPLICATION NO. : 10/707566
DATED : August 15, 2006
INVENTOR(S) : Christopher N. Case et al.

It is certified that error appears in the above-identified patent and that said Letters Patent is hereby corrected as shown below:

Column 7
Line18, delete the word "An"

Signed and Sealed this

Twenty-first Day of November, 2006

JON W. DUDAS
*Director of the United States Patent and Trademark Office*